United States Patent [19]

Johanson et al.

[11] Patent Number: 4,715,086

[45] Date of Patent: Dec. 29, 1987

[54] VACUUM CLEANER AND METHOD OF DISSIPATING ELECTROSTATIC CHARGE THROUGH CORONA DISCHARGE

[75] Inventors: Robert H. Johanson, Danville; Raymond M. Montgomery, Boyle County; Michael T. Herndon, Burgin, all of Ky.; Edward C. Peterson, St. Joseph Township, Berrien County, Mich.

[73] Assignee: Whirlpool Corporation, Benton Harbor, Mich.

[21] Appl. No.: 944,417

[22] Filed: Dec. 19, 1986

[51] Int. Cl.[4] ..... A47L 9/28

[52] U.S. Cl. ..... 15/339; 15/377; 29/829; 29/850; 156/273.9; 156/294; 156/303.1; 174/47; 361/212; 361/220

[58] Field of Search ..... 15/339, 377; 174/47; 361/212, 215, 220, 221, 222; 156/273.9, 274.2, 294, 303.1; 29/829, 850

[56] References Cited

U.S. PATENT DOCUMENTS

| | | | |
|---|---|---|---|
| 1,920,889 | 8/1933 | Pullen | 361/220 X |
| 2,244,635 | 6/1941 | Williamson | 361/215 X |
| 2,430,081 | 11/1947 | Roberts et al. | 156/294 X |
| 3,713,280 | 1/1973 | Keller et al. | 361/220 X |
| 3,780,345 | 12/1973 | Earman | 361/220 |
| 4,194,081 | 3/1980 | Medford et al. | 174/47 |
| 4,215,384 | 7/1980 | Elson | 174/47 X |
| 4,345,297 | 8/1982 | Check | 361/222 X |

*Primary Examiner*—Chris K. Moore

*Attorney, Agent, or Firm*—Mason, Kolehmainen, Rathburn & Wyss

[57] ABSTRACT

A vacuum cleaner includes a floor cleaning unit having a rotatable brush driven by a brush motor and a receptacle for collecting particulate matter. The floor cleaning unit is mechanically and pneumatically interconnected with the receptacle through a rigid wand and a wand handle and hose assembly. The wand handle and hose assembly includes a wand handle, disposed between the rigid wand and a flexible hose. The wand handle includes a passage through which air and particulate matter pass from the floor cleaning unit to the receptable. A corona discharge element with a roughened surface is positioned in the downstream end of the wand handle passage. A stub tube is positioned in the upstream end of the wand handle passage to connect the wand handle to the wand. A conductive strap, installed in the wand handle using a heat staking process, interconnects the stub tube and the corona discharge element. During the operation of the vacuum cleaner, any electrostatic charge that has accumulated on the wand will migrate to the roughened surface of the corona discharge element and will be dissipated or drained off by a corona discharge into the air flowing through the wand handle.

32 Claims, 10 Drawing Figures

10°

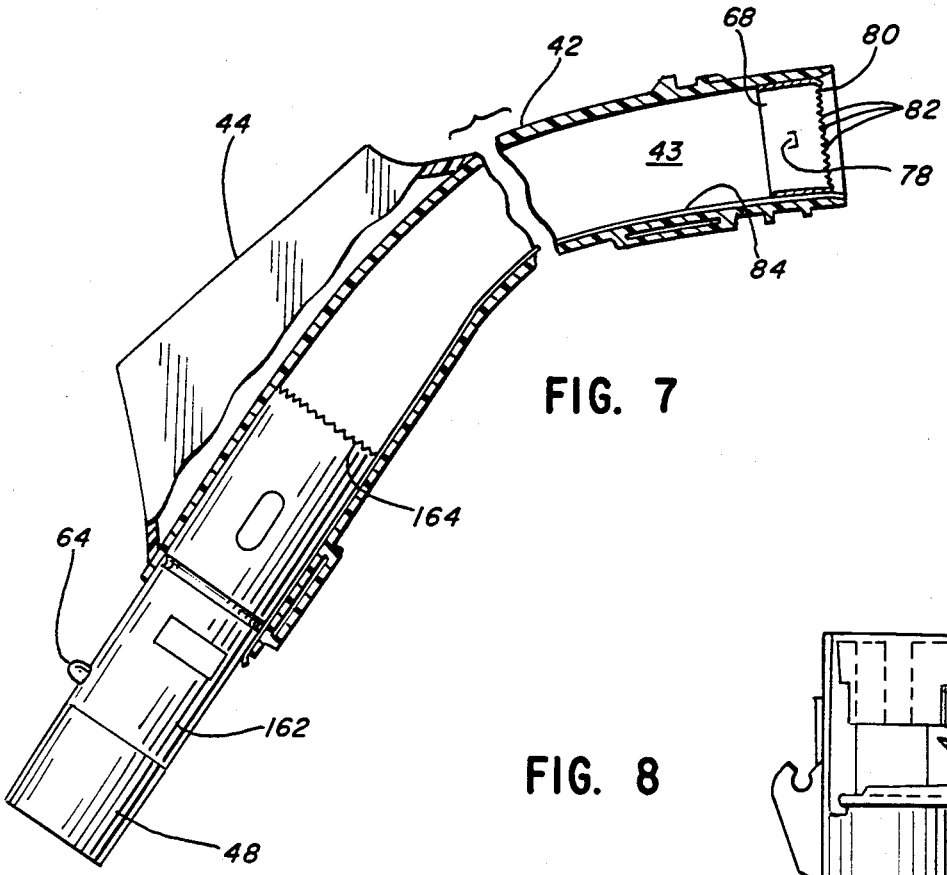
FIG. 7
FIG. 8
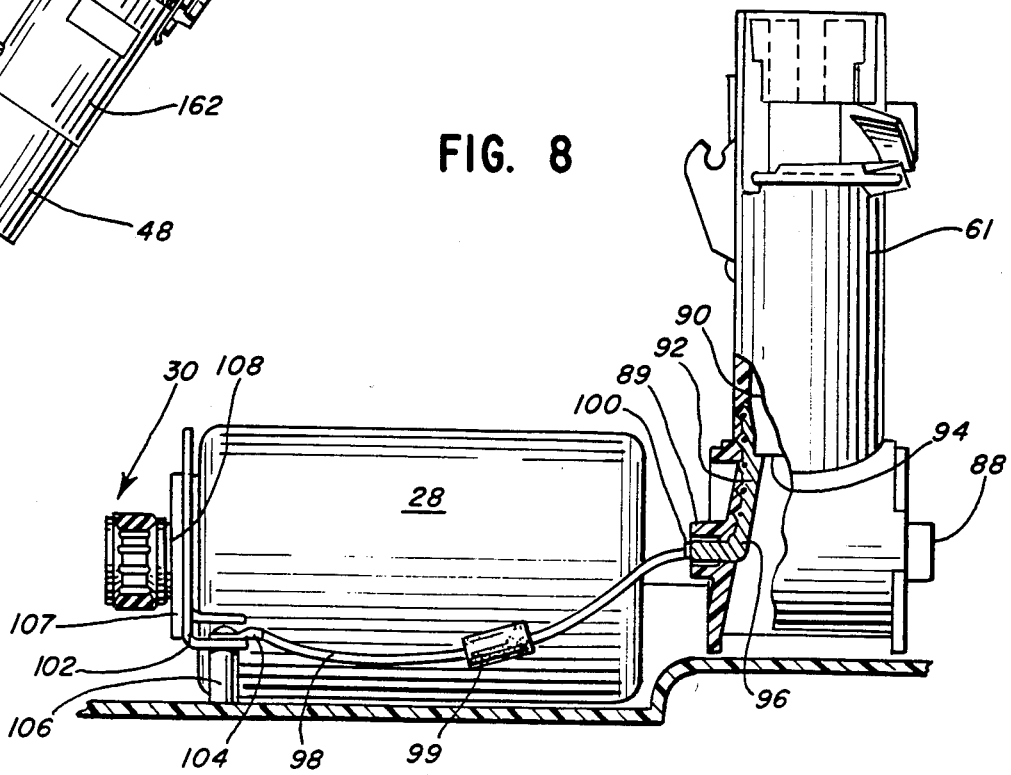

FIG. 9
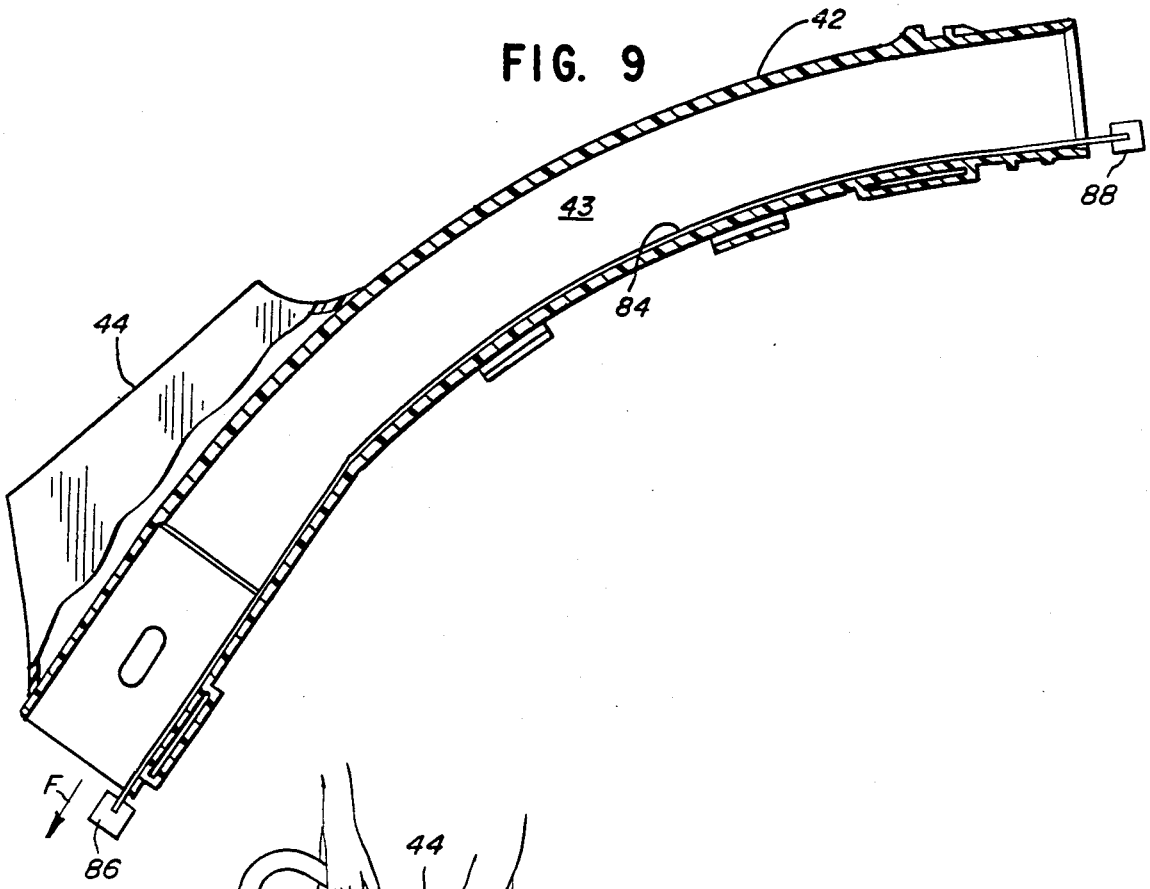
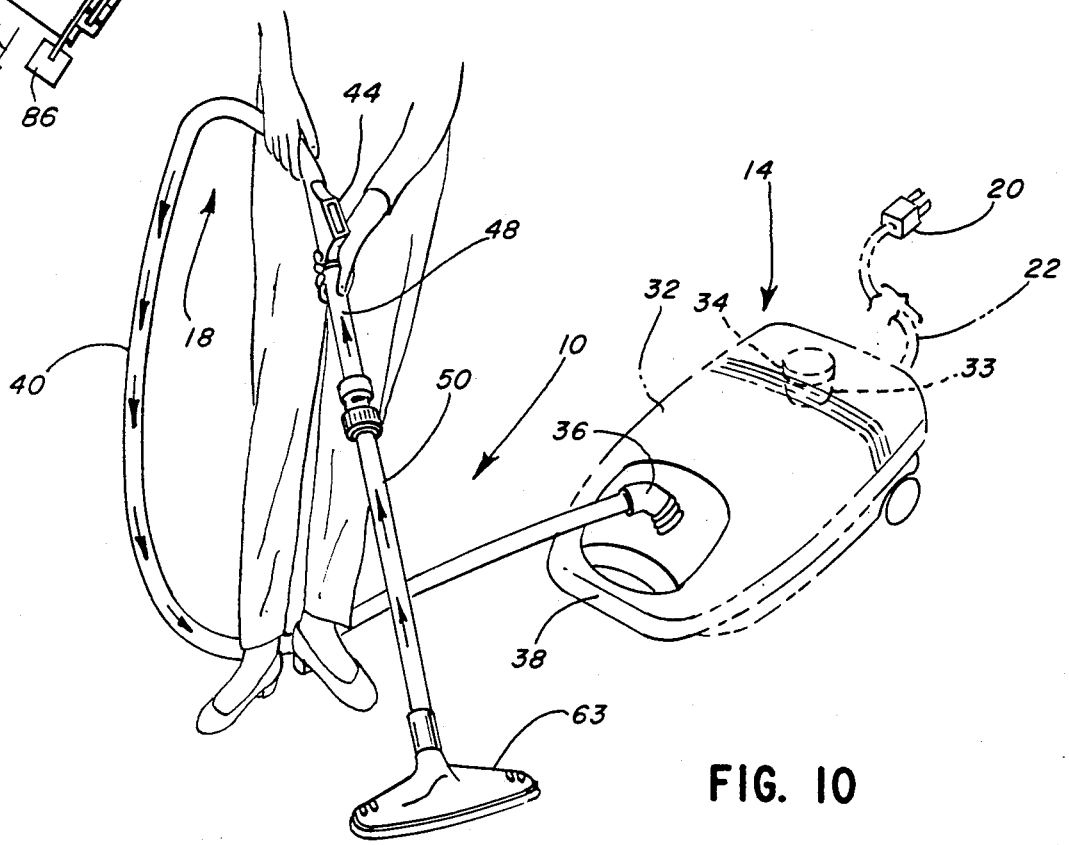
FIG. 10

VACUUM CLEANER AND METHOD OF DISSIPATING ELECTROSTATIC CHARGE THROUGH CORONA DISCHARGE

BACKGROUND OF THE INVENTION

1. Field of the Invention

The present invention generally relates to vacuum cleaners and, more particularly, to a vacuum cleaner constructed to prevent the accumulation of a high level electrostatic charge on its components.

2. Description of the Prior Art

As a general principle, any two dissimilar bodies coming into frictional contact will generate an electrostatic charge. An electrostatic charge may accumulate on components of a vacuum cleaner due to this principle and to the flow of particulate matter passing through the vacuum cleaner. In extreme situations, the accumulated electrostatic charge may reach an electrical potential sufficiently high to cause an electrostatic discharge, risking an unpleasant or harmful shock to the user of the vacuum cleaner or damage to the electrical controls of the vacuum cleaner. Furthermore, the accumulated charge may result in a build up of particulate matter on the inner surfaces of the vacuum cleaner components that in some cases, may interfere with material movement through the vacuum cleaner.

Several efforts have been made in the past to eliminate or control the accumulation of electrostatic charge. One suggested effort involved the use of antistatic material in the fabrication of the components of an implement as discussed in U.S. Pat. No. 2,108,759. The use of antistatic material has the disadvantage of significantly increasing the cost of the implement. Another prior art approach disclosed in U.S. Pat. No. 390,196, involves electrically connecting all the conductive components of an implement and directing a spark discharge to an area of little danger to the implement or the implement user. A significant problem with using that approach on a household implement such as a vacuum cleaner is that the possibility of shock to the user is not necessarily eliminated.

Another proposed solution disclosed in U.S. Pat. No. 1,920,889 is to dissipate the electrostatic charge through the body of the user of an implement. This proposal also has the significant disadvantage of user shock and would be unacceptable for use in vacuum cleaners.

It is desirable in the vacuum cleaner art to maintain the level of the electrical potential due to electrostatic charge accumulation to a level below the threshold for shock sensation detectable by a user, i.e., below the range of approximately 5,000 to 10,000 volts.

SUMMARY OF THE INVENTION

An object of the present invention is to provide a new and improved vacuum cleaner.

Another object of the present invention is to provide a vacuum cleaner constructed to prevent the accumulation of an electrostatic charge during its use.

A further object of the present invention is to provide a new and improved method or process of dissipating an electrostatic charge in a vacuum cleaner during use.

A still further object of the present invention is to provide a vacuum cleaner with a new and improved electrostatic charge dissipating system that provides a conductive path between components of the vacuum cleaner to dissipate an accumulated electrostatic charge by means of an internal corona discharge.

Another object of the present invention is to provide a vacuum cleaner having a new and improved system for dissipating an electrostatic charge from components of the vacuum cleaner that allows the vacuum cleaner to be used with a surface cleaning unit or with other attachments.

A further object of the present invention is to provide a new and improved process for installing a conductive lead or strap in a wand handle of a vacuum cleaner.

Briefly, the present invention constitutes a new and improved vacuum cleaner system for dissipating or draining off an electrostatic charge from components of the vacuum cleaner, thereby reducing the risk of shock to the user and damage to the electrical control system of the vacuum cleaner. The vacuum cleaner may include a rotatable brush powered by a brush motor. The brush and motor are located in a floor cleaning unit remotely disposed from a debris receptacle, normally a porous paper bag, provided for the collection of particulate matter. The floor cleaning unit may be mechanically and pneumatically interconnected to the receptacle through a wand and a wand handle and hose assembly.

During the operation of the vacuum cleaner, particulate matter passing through the wand to the receptacle results in electrostatic charging on the wand and, possibly, on the wand handle. Electrostatic charging may occur during the use of the vacuum cleaner with the floor cleaning unit or with another attachment used to vacuum different surfaces, such as curtains. To dissipate an electrostatic charge from the wand and the wand handle when cleaning with the floor cleaning unit or an attachment, one or more corona discharge elements are mounted in the wand handle. An electrically conductive lead or strap secured in the wand handle by a heat staking process interconnects the wand and any remotely disposed corona discharge element. Each corona discharge element includes a roughened or serrated downstream end to which an electrostatic charge migrates for discharge into the air flowing through the wand handle during the operation of the vacuum cleaner.

An electrostatic charge may also be dissipated or drained off from the wand and the wand handle when the vacuum cleaner is used with the floor cleaning unit by forming a conductive path between these components and the rotating armature of the brush motor in the floor cleaning unit. An electrical conductor is mounted in the floor cleaning unit in a position to engage the wand when the wand is coupled to the floor cleaning unit. An electrically conductive wire is also provided for electrically interconnecting the conductor and the brush motor armature mount. The rotating armature of the brush motor effects the dissipation or draining off of an electrostatic charge from the wand and the wand handle.

The improved vacuum cleaner provides for the dissipation of an electrostatic charge through the full range of use of the vacuum cleaner. This protection is provided by a minimum number of additional parts and at a small incremental cost.

BRIEF DESCRIPTION OF THE DRAWING

The above and other objects, advantages and novel features of the present invention will become apparent from the following detailed description of the preferred embodiment of the present invention illustrated in the accompanying drawing wherein:

FIG. 7 is an enlarged, cross-sectional view, similar to FIG. 2, of an alternative wand handle with a serrated stub tube;

FIG. 8 is an enlarged, partially cross-sectional elevational view depicting electrical connections in the floor cleaning unit of the vacuum cleaner of FIG. 1;

FIG. 9 is an enlarged, cross-sectional view of the wand handle illustrating a heat staking process for securing a conductive lead or strap in the wand handle of the vacuum cleaner of FIG. 1; and FIG. 10 depicts the use of the vacuum cleaner of the present invention with an alternative attachment secured to the wand.

DESCRIPTION OF THE PREFERRED EMBODIMENT

Figures 1, 2, 3, 4, 5, 6:
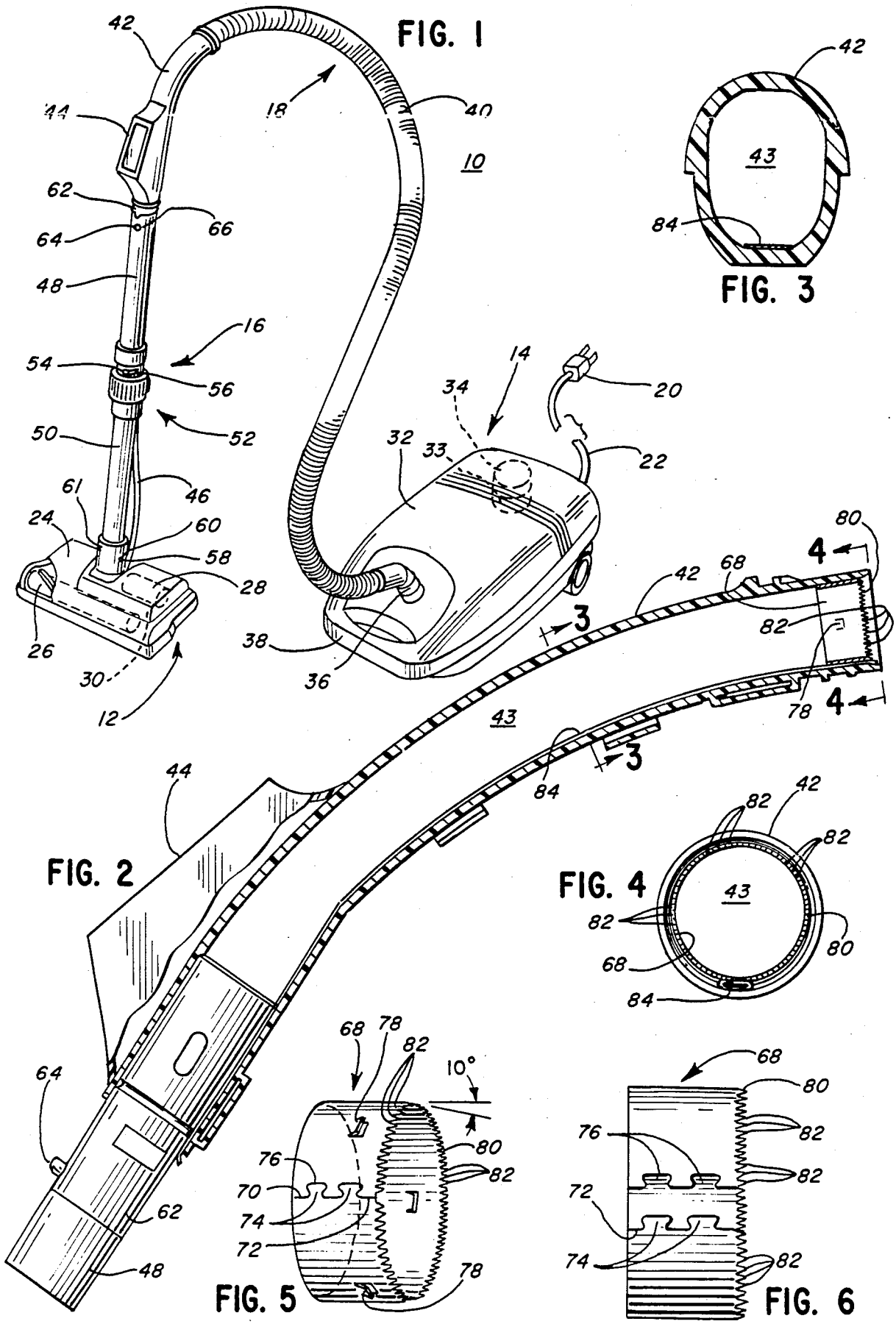
FIG. 1 depicts a vacuum cleaner including components for dissipating an electrostatic charge, constructed in accordance with the principles of the present invention.
FIG. 2 is an enlarged, cross-sectional view of a wand handle of the device of FIG. 1.
FIG. 3 is an enlarged, cross-sectional view generally taken along line 3—3 in FIG. 2.
FIG. 4 is an enlarged end elevational view generally taken from line 4—4 in FIG. 2.
FIG. 5 is an enlarged, perspective view of a corona discharge element adapted to be mounted in the wand handle of FIG. 2.
FIG. 6 is an enlarged, elevational view, similar to the view of FIG. 5, in which the corona discharge element is in an open, pre-installed condition.

Referring to the drawing and initially to FIG. 1, there is illustrated a new and improved canister vacuum cleaner 10 having a new and improved system for dissipating an electrostatic charge constructed in accordance with the principles of the present invention. The vacuum cleaner 10 includes a surface or floor cleaning unit 12 and a remotely disposed canister 14 mechanically and pneumatically interconnected by a wand 16 and a wand handle and hose assembly 18. The vacuum cleaner 10 is powered by conventional, 110–120 volt alternating current power through an electrical plug 20 mechanically and electrically secured to a conventional, retractable, electrical power cord 22.

The floor cleaning unit 12 includes a housing 24 in which are disposed a rotatable brush 26 and an electrical brush motor 28 for rotating the brush 26 through a conventional belt drive assembly 30. The canister 14 includes a housing 32 within which are disposed a conventional dirt collecting bag (not illustrated) and a suction or vacuum fan 33 and a conventional electrical motor 34 for rotating the fan 33. The canister 14 also includes a suction inlet 36 connected to the wand handle and hose assembly 18 and an integrally formed canister handle 38 for enabling the canister 14 to be carried by an operator of the vacuum cleaner 10.

Suction created by the fan 33, when driven by the motor 34, is delivered to the remotely located floor cleaning unit 12 through the wand handle and hose assembly 18 and the wand 16. The wand handle and hose assembly 18 includes a conventional flexible hose 40 and a rigid wand handle 42. The wand handle 42 is preferably plastic, generally tubular in shape and includes an elongated, interiorly disposed tubular bore 43 (FIG. 2) for pneumatically interconnecting the fan 33 in the canister 14 with the floor cleaning unit 12 through the wand 16 and the hose 40. The operation of the vacuum cleaner 10 is controlled by suitable power controls (not shown) disposed in a housing 44 that is an integrally molded part of the wand handle 42. The wand 16 includes an externally disposed power cord 46 that electrically interconnects the electronic controls in housing 44 with the motor 28 in the floor cleaning unit 12.

In order to allow the canister vacuum cleaner 10 to vacuum different surfaces and objects, to be stored, or to use different attachments, the wand 16 may be disconnected at any of three locations. An attachment other than the floor cleaning unit 12 may be connected at any of these locations or the wand 16 may be used without attachments. The wand 16 includes an upper wand section 48 and a lower wand section 50 that may be disconnected from each other or from the floor cleaning unit 12 or from the wand handle 42. The upper wand section 48 is coupled to the lower wand section 50 by a coupling 52. The coupling 52 allows for the quick disconnection of the upper wand section 48 from the lower wand section 50 through the use of a conventional spring biased pin 54 and slot 56 combination. To disconnect the upper wand section 48 from the lower wand section 50, the user of the vacuum cleaner 10 simply depresses the pin 54 and pulls the upper wand section 48 out of the coupling 52. The upper wand section 48 may be used for cleaning or an attachment may be connected to the upper wand section 48 for vacuuming items such as curtains and furniture.

In a similar manner, the lower wand section 50 may be disconnected from the floor cleaning unit 12 through the actuation and movement of a spring biased pin 58 on the lower wand section 50 out of an aperture 60 in a swivel connector 61. Another attachment, such as the attachment 63 (FIG. 10), may be secured to the lower wand section 50 for cleaning; or the lower wand section 50 can be used without an attachment.

The upper wand section 48 is connected to a stub tube 62 securely fixed in the upstream end of the tubular bore 43 of the wand handle 42 (FIG. 2). A quick disconnect connection between the upper wand section 48 and the stub tube 62 is provided by a spring biased pin 64 in the upper wand section 48 and an aperture 66 in the stub tube 62.

During the use of the vacuum cleaner 10, an electrostatic charge can accumulate on the wand 16 due to the flow of particulate matter through the wand 16. In extreme situations in the past, a sufficiently high charge could accumulate resulting in a high static voltage discharge, risking a shock to the user and damage to the vacuum cleaner controls in the housing 44, particularly if those controls include a microprocessor. In accordance with the principles of the present invention, an electrical leakage path is provided for the accumulating charge such that the leakage rate becomes equal to the charging rate. As charged surfaces increase in electrical potential, their natural leakage rate also increases. This increase in natural leakage rate is employed in the present invention to drain off or discharge the accumulated charge through a corona discharge into free space.

To accomplish a corona discharge of an electrostatic charge present in the vacuum cleaner 10, a corona discharge element 68 is mounted in the downstream end of the tubular bore 43 of the wand handle 42 (FIG. 2). In the preferred embodiment, the corona discharge element 68 is a split ring fabricated of stainless steel (FIG.

6). The corona discharge element 68 includes interlocking ends 70 and 72 to provide a tongue and groove connection, i.e., a plurality of tongues 74 on the end 72 interconnect with a plurality of mating grooves 76 on the end 70. By placing the tongues 74 in the grooves 76, the corona discharge element 68 is locked in a closed configuration (FIG. 5) and then may be inserted into the downstream end of the tubular bore 43 of the wand handle 42. The coron discharge element 68 is held within the downstream end of the tubular bore 43 by several outwardly projecting tabs 78 disposed about the periphery of the corona discharge element 68 that functionally engage the inner peripheral surface of the tubular bore 43 to hold the corona discharge element 68 firmly in position.

Since an electrostatic charge tends to migrate to a sharp edge or point at which a corona discharge may occur, the downstream edge 80 of the corona element 68 may be roughened to define a plurality of sharp edges or points. Specifically, the edge 80 may be serrated. To maximize the dissipation of the charge through a corona discharge into the flowing air, it is desirable to provide a large number of serrations 82 and to form the serrations 82 such that they extend in a downstream direction and radially inwardly, slightly into the air flow. Each tip of each serration 82 is inclined radially inwardly approximately 10° (FIG. 5). Further inclination of the tips into the airstream could interrupt the flow; and particulate matter may be caught on the tips tending to block flow through the tubular bore 43.

By locating the corona discharge element 68 in the downstream end of the tubular bore 43, the corona discharge element 68 is spaced from the wand 16 and the stub tube 62. To enable the migration of the electrostatic charge to the corona discharge element 68, an electrically conductive lead or strap 84, preferably made of brass and in physical and electrically conductive contact with both the corona discharge element 68 and the stub tube 62, is secured by a heat staking process to the inner peripheral surface of the wand handle 42 along the tubular bore 43. The strap 84 extends out of the bore 43 at a location to be engaged by the corona discharge element 68 upon its insertion in the downstream end of the bore 43. The strap 84 enables the electrostatic charge on the wand 16 and the stub tube 62 to migrate to the corona discharge element 68 and from there to be dissipated into the air flowing through the wand handle 42.

The conductive strap 84 may be secured to the inside peripheral surface of the tubular bore 43 by a heat staking process. For example, the wand handle 42 may be mounted on a secure surface; and the strap 84 may be positioned along the bottom surface of the tubular bore 43. Positive and negative electrodes 86 and 88 may then be applied to the opposite ends of the strap 84; and a total of approximately four pounds of continuous tensile force "F" (FIG. 9) should be applied through the electrodes 86 and 88 to the ends of the strap 84 to hold the strap 84 against the bottom surface of the bore 43. The strap 84 may then be heated, for example, by supplying twenty amperes of electrical D.C. current through the electrodes 86 and 88 and the strap 84 for approximately twenty-five seconds. Once the heating is terminated, the strap 84 should be allowed to cool for approximately fifteen seconds before the electrodes 86 and 88 are removed. The strap 84 may thus be securely bonded to the plastic wand handle 42 by the above heat staking process and should, after heating and bonding and trimming, be flush with the original inner peripheral surface of the bore 43 to avoid presenting an obstruction to air flowing through bore 43 and to avoid presenting a surface or edge for catching dirt and other particulate matter flowing through the bore 43.

Positioning the corona discharge element 68 in the downstream end of the tubular bore 43 has the advantage of allowing the wand 16 to be disconnected from the floor cleaning unit 12 and to be connected to other attachments (FIG. 10) to clean articles such as curtains and other surfaces. The corona discharge element 68 may be supplemented by the use of an alternative stub tube 162 (FIG. 7) with the vacuum cleaner 10. The alternative stub tube 162 is substantially identical to the stub tube 62 except that a downstream end 164 of the alternative stub tube 162 is roughened to provide a corona discharge surface. Specifically, the end 164 may be serrated substantially in the same manner as the downstream end 80 of the corona discharge element 68. The stub tube 162 and the corona discharge element 68 may be electrically interconnected by the strap 84. An electrostatic charge not dissipated by a corona discharge at the roughened end 164 of the stub tube 162 should migrate to the corona discharge element 68 for dissipation.

In addition to or in place of using a corona discharge to dissipate an accumulated electrostatic charge the charge may be reduced or dissipated by providing a conductive path between the charged parts of the vacuum cleaner 10 and an internally formed drain or dissipation device. In the vacuum cleaner 10 a suitable drain or dissipation device is provided by the armature laminations of the motor 28. An inexpensive method for electrically interconnecting the armature laminations of the motor 28 and the wand 16 utilizes the swivel connector 61 (FIGS. 1 and 8) that is fabricated of a nonconductive material such as plastic and is pivotally mounted on the floor cleaning unit 12 by a pair of pivot pins 88 and 89 positioned in pivot brackets (not shown) on the floor cleaning unit 12. The swivel connector 61 includes a tubular bore 90 through which flowing air and particulate matter collected by the floor cleaning unit 12 pass. An electrically conductive conductor 92 is molded into the inside wall of bore 90 and extends beyond an edge or flange 94 defined in the bore 90. To connect the wand 16 with the swivel connector 61, the wand 16 is inserted into the bore 90 until the downstream end of the wand 16 engages the flange 94. At this point, the pin 58 snaps into the aperture 60 locking the wand 16 in the swivel connector 61. This connection places the downstream end of the wand 16 into physical and electrical contact with the conductor 92.

A lower end 96 (FIG. 8) of the conductor 92 extends through the pivot pin 89. An electrical wire or lead 98 is electrically connected to the lower end 96 of the conductor 92 by a terminal 100. The lead 98 includes a one million ohm safety resistor 99. The lead 98 is also electrically connected to a conductive bracket 102 through a terminal 104. The bracket 102 is mounted on the floor cleaning unit 12 by a post 106 and supports or mounts a bearing assembly 107 in which the armature 108 of the motor 28 rotates. An electrostatic charge accumulating on the wand 16 may, therefore, be dissipated or drained off, for example, by arcing from the armature laminations to other conductive portions of the motor 28 or, possibly, by ionizing the air surrounding the rotating armature 108. As a safety feature, the resistor 99 is placed in series between the wand 16 and the motor 28. The resistor 99 limits any electrical current resulting from the unlikely event of the failure of the insulation of the motor 28. Additionally, it has been found that the resistor 99 limits the rate of static dissipation so as not to generate "noise" (electromagnetic interference), which may disrupt electronic components of the electrical control system of the vacuum cleaner.

Obviously, many modifications and variations of the present invention will become apparent from the above teachings. Thus, it is to be understood that, within the scope of the appended claims, the invention may be practiced otherwise than as specifically described hereinabove.

What is claimed and desired to be secured by Letters Patent of the United States is:

1. A vacuum cleaner comprising an elongate conductive tubular member and means for dissipating an electrostatic charge accumulated on said tubular member, said dissipating means comprising means for effecting a corona discharge into the air flowing within said vacuum cleaner.

2. A vacuum cleaner as recited in claim 1 wherein said means for effecting a corona discharge comprises a corona discharge element.

3. A vacuum cleaner as recited in claim 1 wherein said vacuum cleaner comprises a canister vacuum cleaner, said tubular member comprising a rigid metal wand.

4. A vacuum cleaner as recited in claim 1 further comprising a floor cleaning unit and a remotely disposed canister unit and a flexible hose, said canister unit including suction means for enabling the flow of air through said vacuum cleaner, said tubular member comprising a rigid metal wand, said motor comprising a rotatable brush motor physically disposed in said floor cleaning unit, and said floor cleaning unit being mechanically and pneumatically interconnected by means of said rigid wand and said flexible hose.

5. A vacuum cleaner as recited in claim 1 wherein said vacuum cleaner further comprises a wand handle and a conductive stub tube, said stub tube including a roughened edge.

6. A vacuum cleaner as recited in claim 1 wherein said means for effecting a corona discharge comprises a conductive corona discharge element, said conductive corona discharge element including at least one roughened surface.

7. A vacuum cleaner as recited in claim 1 wherein said vacuum cleaner further comprises a wand handle and wherein said means for effecting a corona discharge comprises a conductive corona discharge element, said wand handle including conductive means for electrically interconnecting said tubular member and said corona discharge element.

8. A vacuum cleaner comprising a surface cleaning unit, a receptacle for particulate matter collected by said surface cleaning unit, means for pneumatically and mechanically interconnecting said surface cleaning unit and said receptacle and means for dissipating an electrostatic charge accumulated on said interconnecting means by means of a corona discharge within said vacuum cleaner.

9. A vacuum cleaner as recited in claim 8 wherein said dissipating means includes a conductive corona discharge ring.

10. A vacuum cleaner as recited in claim 9 wherein said corona discharge ring is fabricated of stainless steel.

11. A vacuum cleaner as recited in claim 8 wherein said dissipating means includes a conductive corona discharge element with at least one roughened surface.

12. A vacuum cleaner as recited in claim 11 further comprising means for producing an air flow from said surface cleaning unit through said interconnecting means to said receptacle, said roughened surface comprises a plurality of serrations, said serrations including tips extending downstream into said air flow.

13. A vacuum cleaner as recited in claim 8 further comprising means for producing an air flow from said surface cleaning unit through said interconnecting means to said receptacle, said dissipating means includes a conductive corona discharge ring, said conductive corona discharge ring having a downstream edge with respect to said air flow and having a plurality of serrations formed at said downstream edge, each of said serrations including a tip radially inclined inwardly into said airstream.

14. A vacuum cleaner as recited in claim 8 wherein said interconnecting means includes a wand handle and a conductive tubular wand interconnecting said surface cleaning unit and said wand handle and a flexible hose interconnecting said wand handle and said receptacle, said dissipating means comprising a conductive corona discharge ring mounted in said wand handle at the juncture of said wand handle and said flexible hose.

15. A vacuum cleaner as recited in claim 14 further comprising conductive means mounted in said wand handle for interconnecting said corona discharge ring and said wand.

16. A vacuum cleaner as recited in claim 8 wherein said dissipating means includes a conductive corona discharge ring, said ring being split and including radially, outwardly extending tabs.

17. A vacuum cleaner as recited in claim 16 wherein said interconnecting means includes a wand handle and a wand, said wand handle including a stub tube configured for connection with said wand, said stub tube including a first edge, said first edge being serrated.

18. A vacuum cleaner as recited in claim 8 wherein said interconnecting means includes a wand handle and a wand, said wand handle including a stub tube configured for connection with said wand, said stub tube including a first edge, said first edge being serrated, said dissipating means further includes a conductive corona discharge ring and conductive means for electrically interconnecting said stub tube and said corona discharge ring.

19. A vacuum cleaner comprising a surface cleaning unit, a receptacle for the collection of particulate matter, means for interconnecting said surface cleaning unit and said receptacle for the passage of said particulate matter, at least a portion of said interconnecting means being electrically conductive, means for creating an air flow from said surface cleaning unit to said receptacle through said interconnecting means and means for discharging an accumulated electrostatic charge from said electrically conductive portion of said interconnecting means into said air flow within said vacuum cleaner.

20. A vacuum cleaner as claimed in claim 19 wherein said discharging means includes an electrically conductive ring with a roughened surface, said surface being in said air flow, and means for electrically connecting said ring and said electrically conductive portion of said interconnecting means.

21. A vacuum cleaner as claimed in claim 19 wherein said discharging means includes an electrically conductive element with a roughened surface, said surface being in said air flow, said roughened surface being serrated, each serration of said surface including a tip inclined into said air flow.

22. A vacuum cleaner as claimed in claim 19 wherein said discharging means includes a roughened surface on an electrically conductive portion of said interconnecting means.

23. A vacuum cleaner as claimed in claim 19 wherein said discharging means includes an electrically conductive element with a roughened surface, said surface being at least partially in said air flow, and a second roughened surface on an electrically conductive portion of said interconnecting means, said conductive element being spaced from said second roughened surface, and means for electrically connecting said conductive element and said second roughened surface.

24. A vacuum cleaner comprising a floor cleaning unit having a rotatable brush and a brush motor for rotating said brush disposed therein, a canister, physically separate from said floor cleaning unit, said canister including means for providing suction disposed therein, means for pneumatically interconnecting said canister and said floor cleaning unit to provide said suction at said floor cleaning unit, said pneumatically interconnecting means comprising a wand and a wand handle and hose assembly, said wand handle and hose assembly comprising a wand handle and a flexible hose, said wand being adapted physically to interconnect with said floor cleaning unit, said flexible hose being adapted physically to interconnect with said canister, said wand handle being adapted physically to interconnect both with said wand and with said flexible hose, and means for effecting a corona discharge positioned in said wand handle.

25. A vacuum cleaner as recited in claim 24 wherein said effecting means includes a serrated edge having a plurality of serrations, each of said serrations including a tip inclined into an internal air flow provided by said suction providing means.

26. A method for dissipating an electrostatic charge on a vacuum cleaner comprising the steps of effecting an air flow through said vacuum cleaner and discharging said electrostatic charge into said air flow.

27. A method for dissipating an electrostatic charge as claimed in claim 26 wherein said discharging step comprises the step of discharging said electrostatic charge into said air flow through a corona discharge.

28. A method of manufacturing a wand handle of a vacuum cleaner comprising the steps of positioning an elongate electrical conductor along and in contact with the inner surface of an elongate bore of said wand handle, attaching electrodes to spaced apart portions of said conductor and passing electrical current through said conductor to heat said conductor and to retain said conductor in contact with said surface.

29. A method of manufacturing a wand handle of a vacuum cleaner as claimed in claim 28 further comprising the step of applying a continuous tensile force to the conductor during said current passing step.

30. A method of installing an electrically conductive strap in a plastic handle of a vacuum cleaner comprising the steps of positioning an electrically conductive strap along an inner peripheral surface of an elongate bore of said handle, applying a continuous tensile force to opposite ends of said strap to maintain said strap in contact with said surface and heating said strap.

31. A method of installing an electrically conductive strap as recited in claim 30 further comprising the step of attaching electrodes to spaced apart portions of said strap.

32. A method of installing an electrically conductive strap as recited in claim 31 wherein said heating step includes the step of passing electrical current through said strap by means of said electrodes.

* * * * *